US005673952A

United States Patent [19]

Chezem et al.

[11] Patent Number: 5,673,952

[45] Date of Patent: Oct. 7, 1997

[54] DOOR STOP

[75] Inventors: Jim A. Chezem, 2307 Kara Dr., Tallahassee, Fla. 32303; Charles E. Benedict; Arthur Williams, both of Tallahassee, Fla.

[73] Assignee: Jim A. Chezem, Tallahassee, Fla.

[21] Appl. No.: 517,767

[22] Filed: Aug. 22, 1995

Related U.S. Application Data

[63] Continuation-in-part of Ser. No. 446,518, May 22, 1995, abandoned.

[51] Int. Cl.[6] ..... E05C 17/44

[52] U.S. Cl. ..... 292/338; 292/339

[58] Field of Search ..... 292/338, 339, 292/342, 343, DIG. 15, 204, 178

[56] References Cited

U.S. PATENT DOCUMENTS

| | | | |
|---|---|---|---|
| 262,978 | 8/1882 | Osborn | 292/DIG. 15 X |
| 282,978 | 8/1883 | Osborn . | |
| 1,530,180 | 3/1925 | Holmes | 211/65 |
| 1,698,944 | 1/1929 | De Foe . | |
| 1,921,568 | 8/1933 | Hasselberger | 292/339 |
| 2,625,080 | 1/1953 | Ferlise | 52/785.1 |
| 2,709,615 | 11/1955 | Barnes, Jr. et al. | 292/339 |
| 2,739,005 | 3/1956 | Naffziger | 292/339 |
| 2,774,622 | 12/1956 | Priebe | 292/339 |
| 3,049,772 | 8/1962 | Anderson | 24/66.8 |
| 3,737,186 | 6/1973 | Chezem . | |
| 3,809,419 | 5/1974 | Chezem . | |
| 4,163,574 | 8/1979 | Chezem . | |
| 4,421,348 | 12/1983 | Kahn | 292/339 |
| 4,456,291 | 6/1984 | Brogie . | |
| 4,514,000 | 4/1985 | Chezem et al. | 292/338 |
| 4,585,259 | 4/1986 | Vidas | 292/339 |
| 4,673,203 | 6/1987 | Chezem | 292/339 |
| 4,805,948 | 2/1989 | Renzi | 292/342 |
| 4,967,453 | 11/1990 | MacDonald . | |
| 5,135,273 | 8/1992 | MacCalder . | |

FOREIGN PATENT DOCUMENTS

| | | | |
|---|---|---|---|
| 362901 | 11/1922 | Germany | 24/530 |

*Primary Examiner*—Steven N. Meyers
*Assistant Examiner*—Donald J. Lecher
*Attorney, Agent, or Firm*—Dowell & Dowell

[57] ABSTRACT

A door stop includes a mounting bracket for mounting to a swingable door, a base which is connectible to the mounting bracket, and a leg pivotally connected to the base and having an end for engaging a floor in an operative condition of the door stop. In one embodiment, the mounting bracket is detachably mountable to doors of different thicknesses and the base is detachable from the mounting bracket so that the door stop can be disassembled when not in use, and the base can be used with alternative mounting brackets. The base is preferably vertically adjustable relative to the mounting bracket and the leg can be releasably locked in a range of different angular positions. The door stop may optionally not include a mounting bracket with the base being attached directly to the door.

21 Claims, 5 Drawing Sheets

DOOR STOP

CROSS-REFERENCED TO RELATED APPLICATIONS

This application is a continuation-in-part of U.S. patent application Ser. No. 08/446,518, filed on May 22, 1995, and abandoned on Oct. 9, 1996.

BACKGROUND OF THE INVENTION

1. Field of the Invention

The invention relates to the field of door stops and, more particularly, to a door stop which may be portable, for use with swingable doors.

2. Background of the Related Art

Security door stops for swingable doors include types which are permanently attached to either the door or the adjacent floor area, and other types which are temporarily attachable to the door. Door stops are typically employed to supplement conventional door locks.

Door stops have experienced an increased popularity in recent years due to an increase in the rate of breaking and entering into homes and other buildings and a related enhanced safety awareness of individuals. Home and building owners have responded to the increased crime rate by installing security devices that provide a sense of personal safety to persons inside secured areas. Door stops greatly enhance the difficulty of breaking and entering through locked doors and, consequently, are a popular security device.

Personal security is also a persistent concern to individuals while traveling. Individuals staying at hotels, motels, and other types of lodging, are often alone in their rooms and especially vulnerable at these times to crime. While larger hotels often have security personnel on duty and improved door locks, other establishments generally lack such enhanced security provisions. Moreover, door stops are not normally used in any type of lodging.

Thus, there has been a need for an improved door stop, which may be portable and suitable to be carried by travelers, easy to install on swingable doors by all individuals, and which provides a high level of protection against forced entry through such doors when used alone or in combination with other door locks.

SUMMARY OF THE INVENTION

The present invention has been made in view of the above-described disadvantages of the known door stops and has as an object to provide an improved door stop which is installed on swingable doors to prevent forced entry into secured areas.

It is another object of the invention to provide an improved door stop which can be used alone, or to supplement existing door locks.

It is yet another object of the invention to provide an improved door stop which is compact in size and which, in some embodiments, may be readily installed on doors without the use of tools, and thus is ideally suitable for use by travelers.

To achieve the objects of the invention, as embodied and broadly described herein, the door stop in accordance with a preferred embodiment of the invention is suitable for installing on a swingable door having an inner face and an outer face. The door stop is comprised of a base which is attachable to inner face of the door, and a leg pivotally connected to the base. The base includes a vertical wall which defines an opening. The leg includes a front wall which defines an opening, an upper portion and a lower portion. The upper portion is pivotally connected to the base about a pivot axis such that the leg is pivotable to an operative position in which the lower portion engages the floor and retains the door in a fixed position. A spring is disposed on the pivot axis to resiliently bias the leg outwardly away from the base. The door stop also comprises a locking member which includes a flat front portion which abuts the front wall of the leg, and a rear portion which extends through the openings in the leg and base and includes a locking portion. The locking portion is releasably engageable with the base to retain the leg in an operative position. The flat front portion of the locking member remains in parallel, abutting relationship with the front wall of the leg when the locking portion is disengaged from the base and the leg is pivoted about the pivot axis.

In another preferred embodiment, the door stop is includes a mounting bracket which has a clamping means for detachably clamping the door stop to a door. In this embodiment, the base is detachably connectible to the mounting bracket.

DETAILED DESCRIPTION OF THE PREFERRED EMBODIMENT

Figure 1:
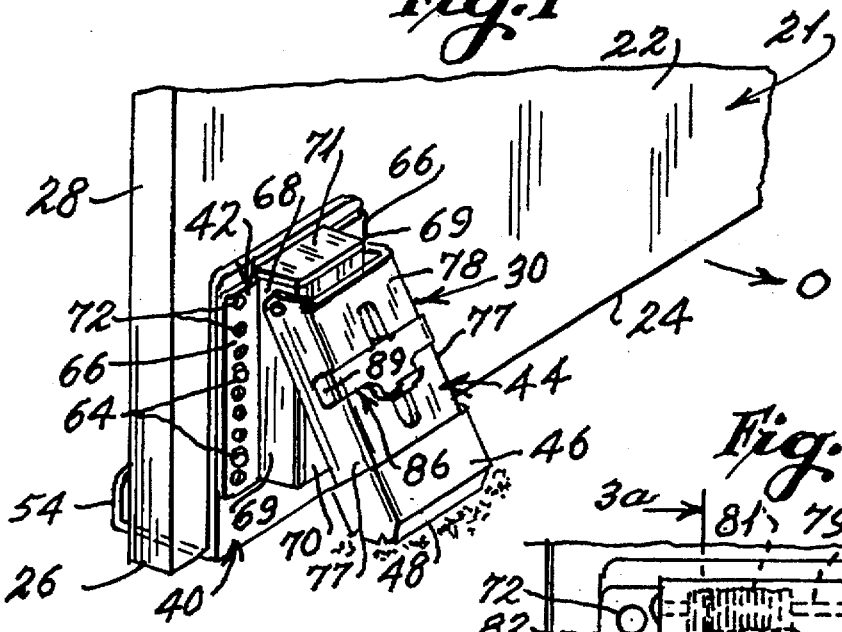
FIG. 1 is an illustrational view of a door stop in accordance with a first embodiment of the invention installed on a swingable door.

The invention will now be described in detail in conjunction with the drawing figures. In the drawings, common reference numbers identify common elements illustrated in different figures.

FIG. 1 illustrates a door stop generally 30 in accordance with a first embodiment of the invention installed on a door 21. The door includes an inner face 22 which opposes a secured area, a bottom edge 24 which faces a floor surface 48, a side edge 26 and an outer face 28. The door is inwardly swingable to open positions as represented by arrow "O". It should be noted that the present invention may be used on both inwardly and outwardly swingable doors.

The door stop 30 comprises a mounting bracket 40 which is shown mounted to the door 21, a base 42 detachably connected to the mounting bracket 40, and a leg 44 pivotally connected to the base. The leg 44 is illustrated in an operative position in which a foot 46 disposed on its lower end contacts the floor 48 and prevents the door 21 from being opened.

Figure 3A:
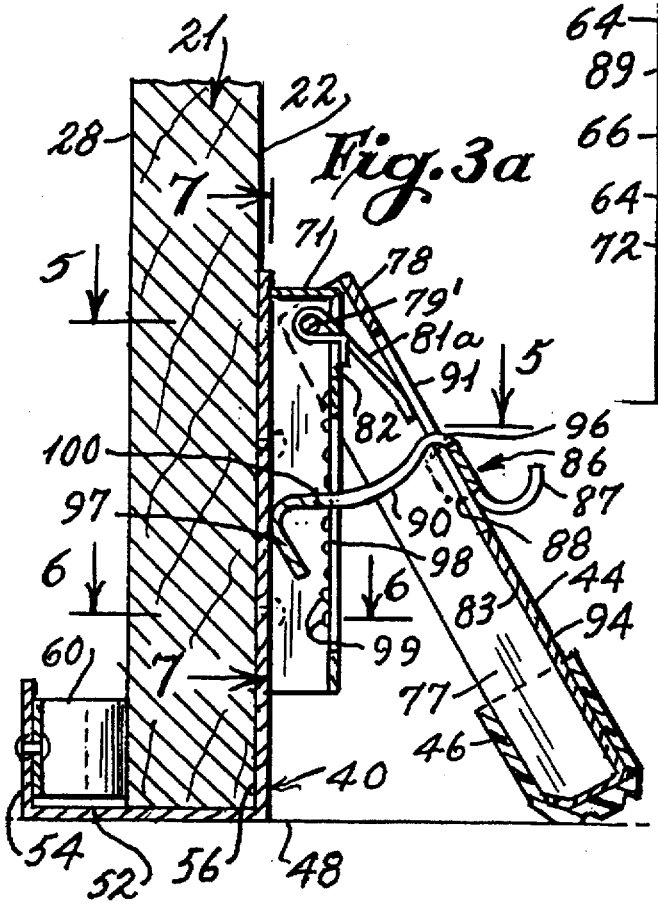
FIG. 3*a* is an offset cross-sectional view in the direction of lines 3—3 of FIG. 2 illustrating the leg in a locked position.
Figure 9:
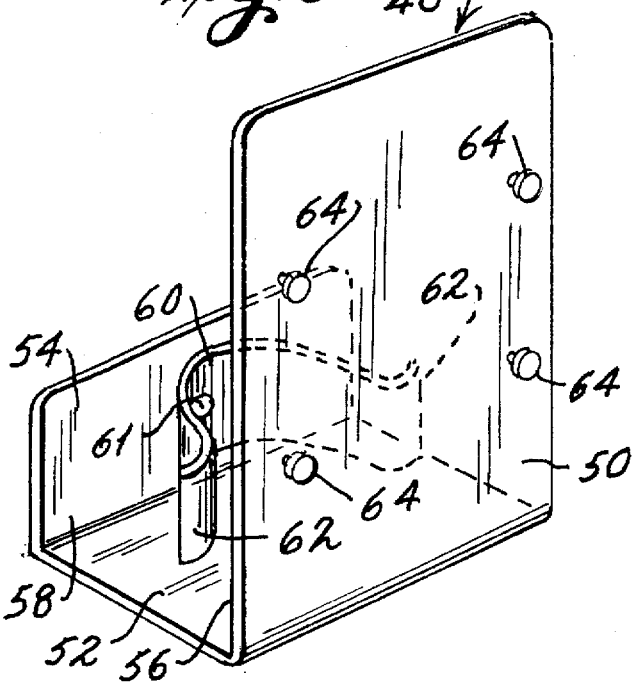
FIG. 9 is a perspective view of a first embodiment of a mounting bracket of the door stop in accordance with the present invention.

As shown in FIG. 9, the mounting bracket 40 comprises a vertical front wall 50, a horizontal base 52 and a vertical rear wall 54. Referring to FIG. 3*a*, the rear face 56 of the front wall 50 contacts the inner face 22 of the door 21 when the mounting bracket is installed. The rear face 56 is preferably coated with a suitable material such as Teflon™ to protect the door from being scratched or marked by the mounting bracket.

In accordance with the invention, the mounting bracket 40 includes means for clamping to a door. Referring to FIG. 9, one embodiment of clamping means is a resilient element such as the spring 60 secured to the rear wall 54 by a fastener 61. The spring 60 has a curved shape and includes forward portions 62 which, as shown in FIG. 3*a*, contact the outer face 28 of the door 21 in a compressed condition of the spring and maintain the mounting bracket in a fixed position on the door. A suitable material such as Teflon™ is preferably coated on the outer surface of the spring to prevent scratching of the door.

The stiffness of the spring 60 is selected to enable the mounting bracket 40 to be easily installed on a door, and also to assert a sufficient clamping force on the door to hold the mounting bracket in the installed position. In the actuated condition of the door stop illustrated in FIG. 1, the forces acting on the door stop supplement the spring and further hold the mounting bracket in a fixed position on the door 21.

Mounting elements are provided on the front wall 50 of the mounting bracket 40 for detachably supporting the base 42. As shown in FIG. 9, the mounting elements may include vertically spaced pairs of horizontally aligned rivets 64.

Figure 2:
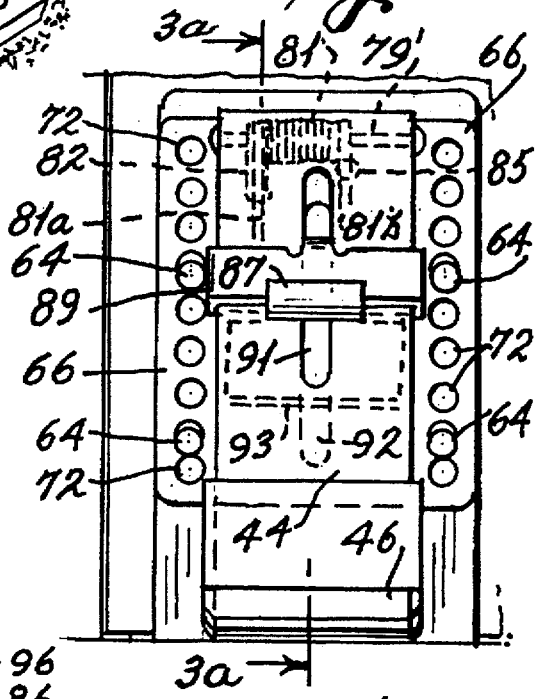
FIG. 2 is a front elevational view illustrating the base and leg of the door stop of FIG. 1.

As illustrated in FIGS. 1 and 2, the base 42 is comprised of a pair of flat mounting portions 66 and an intermediate portion 68 having side walls 69, a front wall 70 and a top wall 71. A plurality of vertically spaced mounting holes 72 are formed in each mounting portion 66, such that each hole 72 is horizontally aligned with a hole in the opposite mounting portion. Selected holes 72 are fitted over the rivets 64 provided on the mounting bracket 40 as depicted in FIG. 2, to mount the base to the mounting bracket. The mounting holes 72 enable the base 42 to be mounted at different vertical positions, so that for different sized gaps between the bottom edge 24 of the door and the floor 48, the leg 44 is able to contact the floor.

Figure 8:
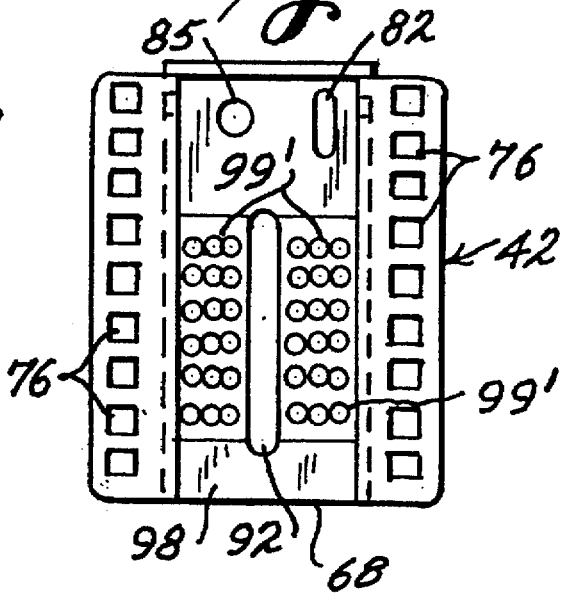
FIG. 8 is an elevational view of another preferred embodiment of the base of the door stop of the present invention.
Figure 10:
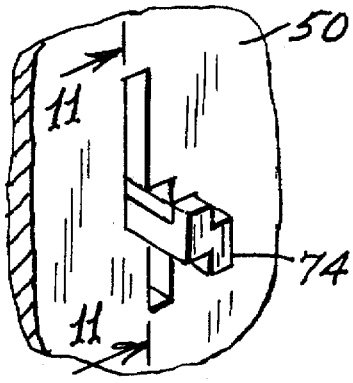
FIG. 10 is an enlarged perspective view of an alternate embodiment for a stud for use with mounting bracket of FIG. 9.
Figure 11:
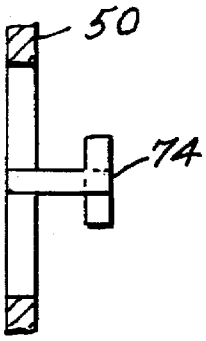
FIG. 11 is a partial cross-sectional view in the direction of lines 11—11 of FIG. 10.

Referring to FIG. 10, the mounting elements provided on the forward wall 50 of the mounting bracket 40 may optionally be studs 74. The base 42 is attached to the mounting bracket by inserting the studs through suitable shaped holes or slots 76 formed in the base (FIG. 8). When the door stop is actuated, the door is jammed in the closed position, and attempts at opening the closed door cause the leg to more firmly engage the floor.

Figure 5:
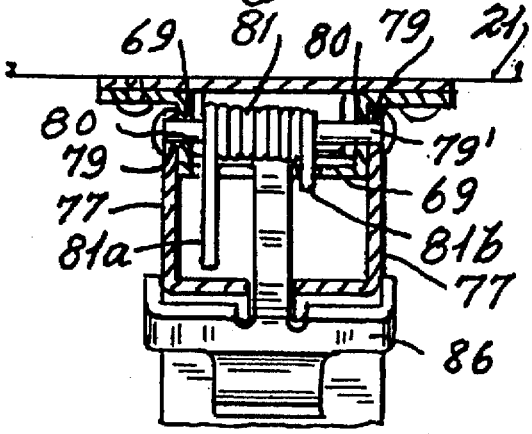
FIG. 5 is an offset cross-sectional view in the direction of line 5—5 of FIG. 3*a;*
Figure 6:
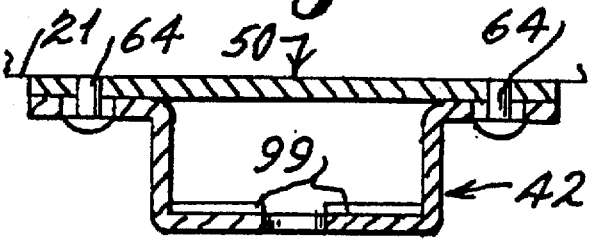
FIG. 6 is a cross-sectional view in the direction of line 6—6 of FIG. 1.

As shown in FIG. 1, the leg 44 is generally U-shaped and of a greater width than the intermediate portion 68 of the base 42. The leg includes opposed side walls 77 and a front wall 78. Referring to FIG. 5, apertures 79 are formed in the side walls 77 of the leg 44 and are aligned with apertures 80 in the side walls 69 of the intermediate portion 68, and a pivot pin 79' extends through the apertures 79, 80 to pivotally support the leg.

Referring to FIG. 3*a*, the shoe 46 provided on the lower end of the leg 44 is preferably composed of a resilient material such as rubber to firmly engage different floor surfaces, as well as floor coverings such as rugs and carpeting, without damaging the floor or floor covering. The shoe may also function as a stop to cushion the full opening contact of the door and a surrounding wall (not shown).

Referring to FIGS. 2 and 3*a*, a spring 81 is disposed on the pivot pin 79' within the intermediate portion 68 of the base 42 to resiliently bias the leg 44 outwardly away from the base. The spring 81 is preferably a torsion spring having an flexible end portion 81*a* and a fixed end portion 81*b*. The flexible end portion 81*a* extends through an elongated vertical slot 82 formed in the front wall 70 of the intermediate portion 68 and contacts the inner face 83 of the front wall 78 of the leg 44. The fixed end portion 81*b* extends through a hole 85 formed in the front wall 70 of the base.

Figure 4:
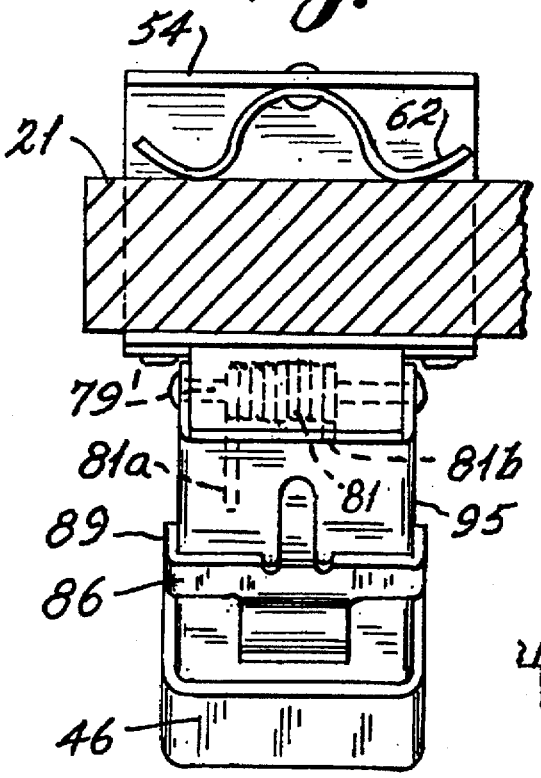
FIG. 4 is a top plan view of the door stop of FIG. 1.

A lock bar 86 releasably retains the leg 44 in a selected inclined operative position relative to the base 42. The lock bar 86 includes a curved locking release portion 87, a flat front portion 88, flat, downward turned, side portions 89 (FIG. 4), and a bar portion 90 which extends rearwardly from the front portion 88 through an elongated opening 91 formed in the front wall 78 of the leg 44 and through an elongated slot 92 formed in the front wall 70 of the base 42, and the bar portion terminates at an end 93.

The flat front portion 88 of the lock bar 86 abuts the outer surface 94 of the front wall 78 of the leg 44, and the flat side portions 89 abut the side walls 77 of the leg. The lock bar 86 is guided upwardly in a parallel, abutting relationship relative to the outer surface 94 when the leg is released from the locked position and rotated in the counter-clockwise direction.

As illustrated in FIG. 3*a*, the bar portion 90 of the lock bar 86 is preferably arcuate shaped to apply force in the necessary direction on the front wall 70 of the base 42 to prevent the lock bar from sliding upward relative to the leg 44 when inwardly directed force is applied to the door. The bar portion 90 includes a bend 96 at the front wall 78 of the leg 44 and a bend 97 proximate to the forward wall 50 of the mounting bracket 40. The contour of the bar portion 90 causes the flat front portion 88 of the lock bar 86 to remain in full surface contact with the front wall 78 of the leg.

In accordance with the invention, the bar portion 90 of the lock bar 86 may be provided in other suitable geometrical configurations that maintain the flat front portion 78 of the lock bar in full contact with the leg 44. The lock bar may be straight or bent at the front portion, while the bar portion is pivoted on the base such that the bar portion tilts downward as load is applied, causing the forces to act in a downward direction to prevent the lock bar from sliding upward. The configuration of the bar portion of the lock bar can be selected so that the forces are always directed downward by contact between the lock bar and the base.

Referring to FIG. 3*a*, the lock bar 86 includes a locking portion 100 which engages the inner surface 98 of the intermediate portion 68 of the base 42 to lock the leg 44 in an inclined position such as shown. The locking portion 100 is approximately perpendicular to the inner surface 98 when the lock bar is in a locking position such as shown.

As depicted in FIG. 2, the locking portion 100 preferably has a substantially flat shape, and a width substantially equal to that of the inner surface 98 of the base 42. The front face (not shown) of the locking portion which engages the inner surface 98 of the base can have a sharp, flat or rounded shape. Spurs, striations or the like may be formed on the locking portion to enhance engagement with the base.

Figure 3B:
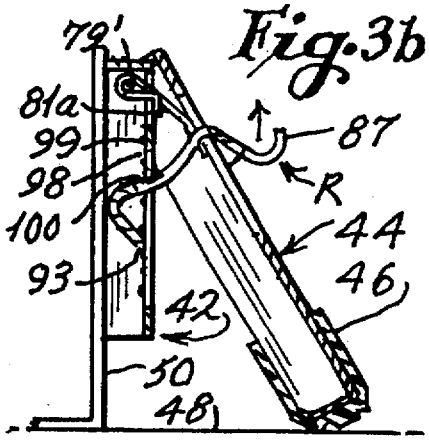
FIG. 3*b* is a view similar to FIG. 3*a* showing the locking member in an unlocked position of the leg.
Figure 7:
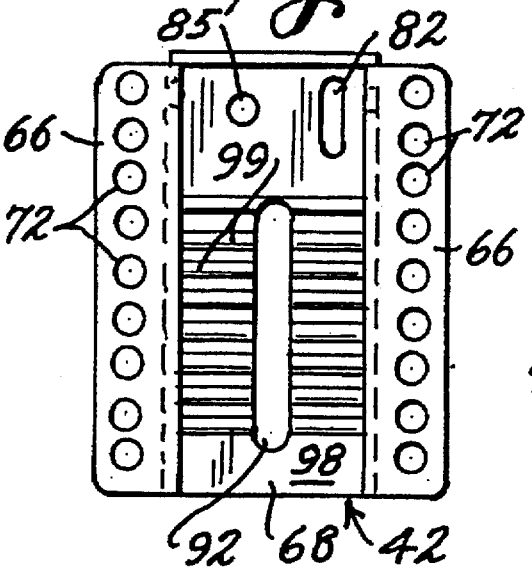
FIG. 7 is an elevational view in the direction of line 7—7 of FIG. 3*a* illustrating one embodiment of the base of the door stop.

The inner surface 98 of the base 42 contacted by the locking portion 100 of the lock bar 86 is preferably textured by forming protuberances such as ridges, dimples or the like. FIGS. 3*a*, 3*b* and 7 illustrate a plurality of horizontally spaced ridges 99 formed on the inner surface 98. The protuberances preferably extend substantially across the width of the inner surface 98 as shown. The locking portion 100 of the lock bar engages between adjacent ridges 99 and is maintained in a fixed position relative to the base.

As depicted in FIG. 3*b* the inclination of the leg 42 is adjusted by applying an upward force "R" to the locking release portion 87 of the lock bar 86 to disengage the locking portion 100 from the inner surface 98 of the base 42. Rotation of the lock bar in the counter-clockwise direction moves the end 93 toward the inner surface 98 of the base. In the illustrated released position of the locking portion 100, the leg can be rotated until the desired inclination relative to the base is achieved. The lock bar 86 is moved downwardly to decrease the angular inclination of the leg. The locking portion 100 moves vertically relative to the inner surface 98 of the base 42 between adjacent pairs of protuberances 99 to enable a stepwise-type adjustment of the leg.

FIG. 8 illustrates an optional dimpled surface texture 99' formed on the inner surface 98 of the base 42. The locking portion 100 of the lock bar engages between adjacent rows of dimples to maintain the leg 44 in an inclined position relative to the base.

An abrasive material (not shown) may optionally be provided on the inner surface 98 of the base 42 to cause the locking movement of the lock bar 86 relative to the base to be infinitesimal.

Figure 12:
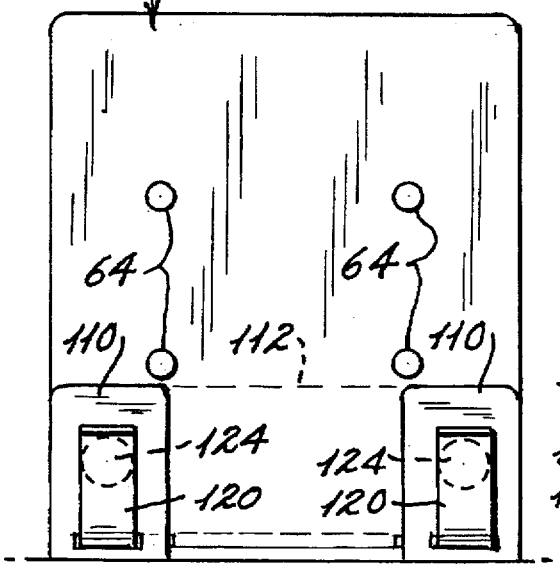
FIG. 12 is a front elevational view of another embodiment of mounting bracket of the door stop in accordance with the present invention.
Figure 13:
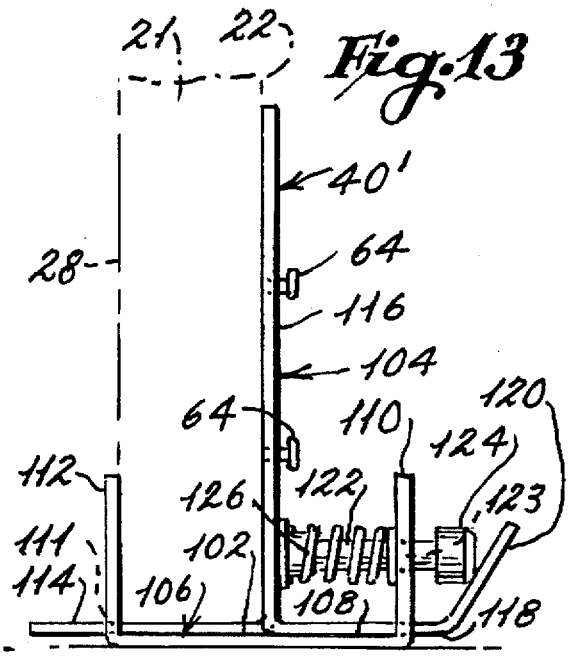
FIG. 13 is a side view of the mounting bracket illustrated in FIG. 12.
Figure 14:
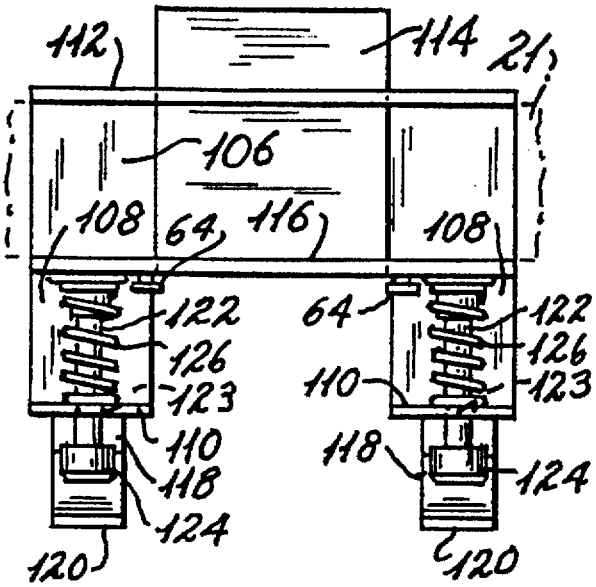
FIG. 14 is a top plan view of the mounting bracket of FIG. 13.
Figure 15:
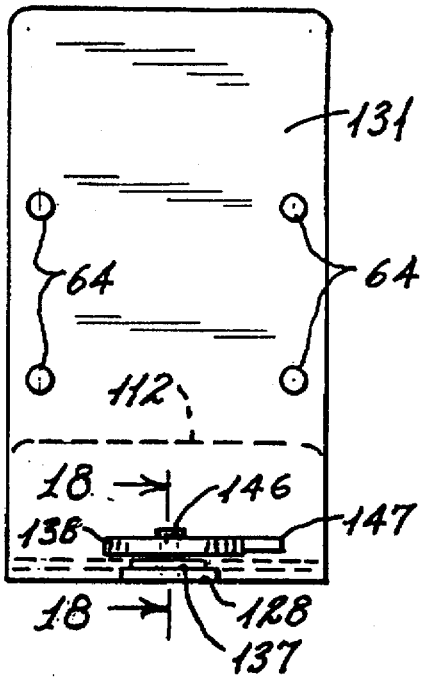
FIG. 15 is a front elevational view of another embodiment of mounting bracket of the door stop in accordance with the present invention.
Figure 16:
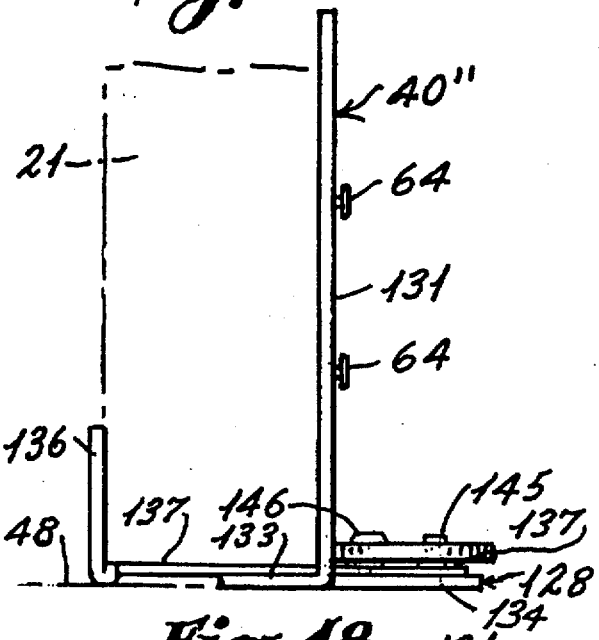
FIG. 16 is a side elevational view of the mounting bracket illustrated in FIG. 15.

Another embodiment of the mounting bracket 40' is illustrated in FIGS. 12–14. The mounting bracket 40' comprises a stationary bracket 102 and a movable bracket 104 which is movable relative to the stationary bracket to enable the mounting bracket 40' to be mounted to a door. The stationary bracket 102 comprises a base 106 which includes a pair of parallel, forward extending portions 108 which each terminate in a vertical forward wall 110, and the base terminates at the opposite end at a vertical rear wall 112 defining a horizontal opening 111.

The movable bracket comprises a rear base portion 114 which extends through the opening 111 in the rear wall 112 of the stationary bracket, a vertical rear wall 116, and a pair of spaced, parallel leg portions 118 which extend forwardly from the rear wall 116. The leg portions 118 each terminate in an inclined forward wall 120.

Spring biasing means are disposed between the stationary bracket 102 and the movable bracket 104 to hold the mounting bracket 40' in a fixed position on the door 21. As shown in FIGS. 13 and 14, horizontal posts 122 are mounted to the rear wall 116 of the movable bracket 104, and the posts 122 each extend forwardly above a respective leg portion 118 and through an opening 123 defined in a respective forward wall 110 of the stationary bracket 102. Each post has an enlarged front end 124 having a diameter greater than the associated opening 123.

A coil spring 126 is positioned on each post 122 between the rear wall 116 of the movable bracket 104 and the forward walls 110 of the stationary bracket 102. The springs 126 urge the movable bracket 104 rearwardly toward the stationary bracket 102. The stiffness of the springs 126 is selected to firmly maintain the mounting bracket on the door 21 as illustrated in FIG. 13, even during adjustment of the door stop. As shown, the rear wall 112 of the stationary bracket 102 abuts the outer face 28 of the door, and the rear wall 116 of the movable bracket 104 abuts the inner face 22 of the door in the installed condition of the mounting bracket.

Another embodiment of the mounting bracket 40" in accordance with the invention is illustrated in FIGS. 15–18. The mounting bracket 40" comprises a stationary bracket 128 and a movable bracket 130 which moves linearly over the stationary bracket. The stationary bracket 128 comprises a vertical forward wall 131 which defines a horizontal slot 132, and a horizontal base portion 133 which contacts the floor 48 in the installed condition. A base portion 134 extends forwardly of the forward wall 131.

The movable bracket 130 comprises a vertical rear wall 136, and a horizontal base 137 which extends through the horizontal slot 132 in the forward wall 131 of the stationary bracket 128.

Figure 17:
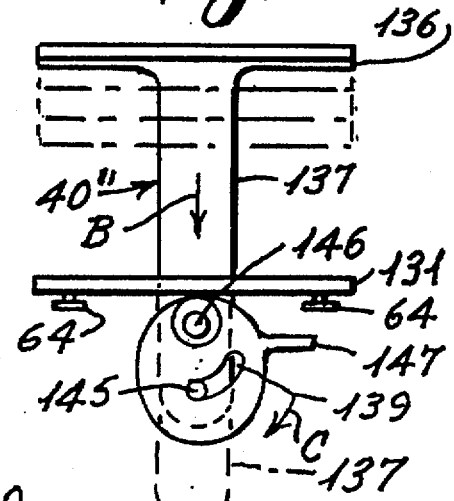
FIG. 17 is a top illustrational view of the operation of the mounting bracket of FIG. 15.
Figure 18:
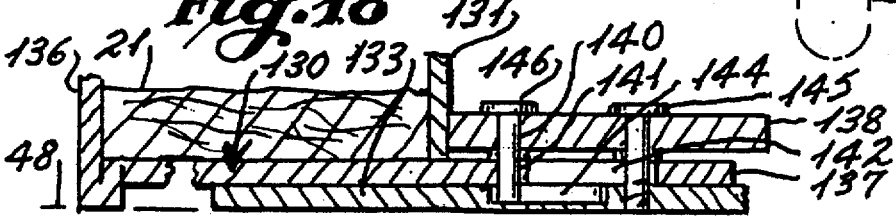
FIG. 18 is a cross-sectional view in the direction of line 18—18 of FIG. 15.

Referring to FIG. 17, the mounting bracket 40" comprises means for moving the movable bracket 130 forwardly relative to the stationary bracket 128 in the direction of arrow "B" to vary the distance between the rear wall 136 of the movable bracket and the forward wall 131 of the stationary bracket as represented by the series of dotted lines. This adjustability enables the mounting bracket to be installed on doors having different conventional thicknesses.

The clamping means of the mounting bracket 40" comprises a cam 138 defining an arcuate slot 139 and an aperture 140. The movable bracket 130 defines an aperture 141 in alignment with the aperture 140 in the cam, and an elongated slot 142. The base portion 134 of the stationary bracket 128 defines a threaded aperture 143 in alignment with the slot 139 in the cam, and also an elongated slot 144. A fastener 145 extends through the slot 139, and is threaded at a lower end to engage the threaded aperture 143. A pin 146 is mounted in an off-center position and extends through the aperture 140 in the cam 138 and the aperture 141 in the movable bracket, and is received in the slot 144 in the stationary bracket.

The movable bracket 130 is moved forwardly relative to the stationary bracket 128 by engaging an operating handle 147 and rotating the cam 138 in a clockwise direction as represented by arrow "C". This rotation of the cam causes the pin 146 to move forwardly in the slot 144, and the fastener 145 to move along the slot 142. The movable bracket is moved forwardly until the mounting bracket firmly engages the door. The movable bracket is firmly maintained in this position by the cam. The mounting bracket is disengaged from the door by rotating the cam in the counter-clockwise direction to move the rear wall 136 of the movable bracket away from the door.

Figure 19:
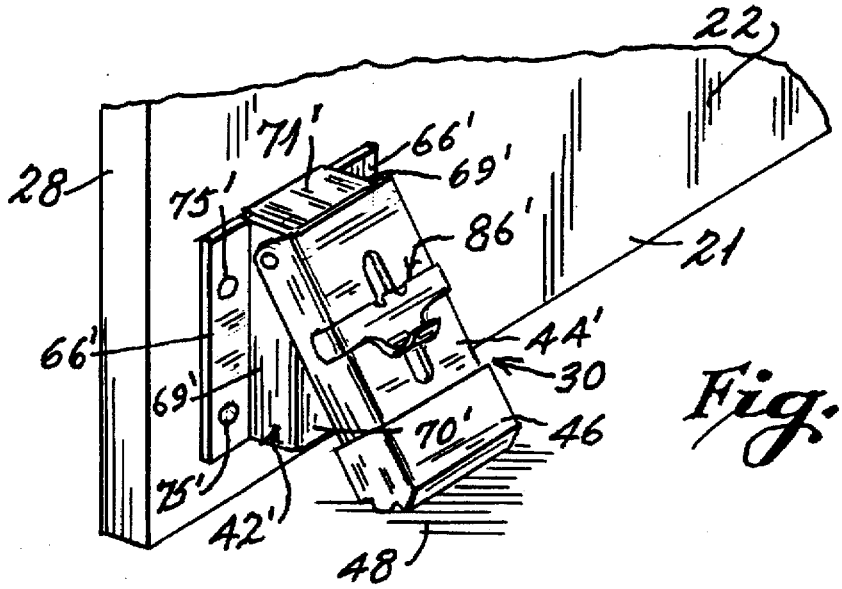
FIG. 19 is an illustrational view of a door stop in accordance with another embodiment of the invention installed on an inwardly swingable door.
Figure 20:
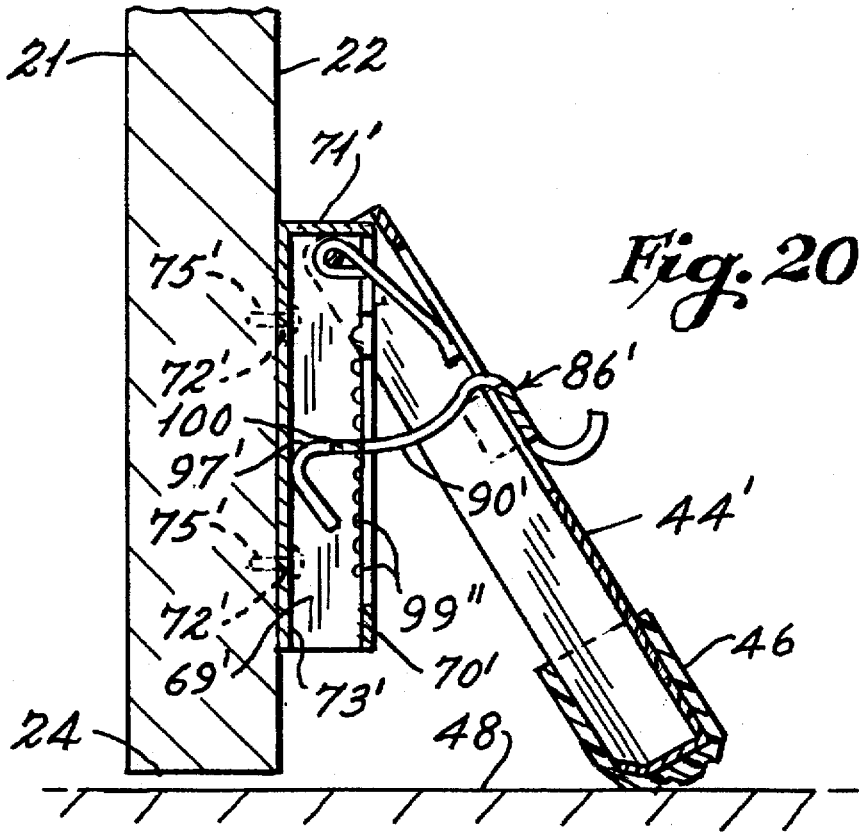
FIG. 20 is an offset cross-sectional view similar to FIG. 3*a* of the door stop of FIG. 19 illustrating the leg in a locked position.

FIGS. 19 and 20 illustrate a door stop 30' in accordance with yet another embodiment of the invention, which is intended for permanent attachment to a door. As shown, the door stop is comprised of a base 42' which includes a pair of flat mounting portions 66' and an intermediate portion having side walls 69', a front wall 70', a rear wall 73' and a top wall 71'. A pair of vertically spaced mounting holes 72' are formed in each mounting portion 66' (only one pair is shown), such that each hole 72' is horizontally aligned with a hole in the opposite mounting portion. Fasteners 75' such as screws or the like are inserted through the mounting holes 72' and the inner face 22 of the door to mount the base directly to the door 21. The pairs of mounting holes 72' enable the base 42' to be permanently mounted in different vertical positions on the door, depending on the, size of the gap between the bottom edge 24 of the door and the floor 48.

As shown, the door stop 30' is comprised of a leg 44' and a lock bar 86', both preferably of the same construction as in the embodiment of the door stop 30 illustrated in FIGS. 1–18. As shown in FIG. 20, the bend 97' in the bar portion 90' of the lock bar is proximate to the rear wall 73' of the base 42' in the illustrated locked position of the leg. In this position, the locking portion 100' of the lock bar is engaged between protuberances 99" on the front wall 70' of the base.

The foregoing description of the preferred embodiment of the invention has been presented to illustrate the principles of the invention and not to limit the invention to the particular embodiment illustrated. The scope of the invention is defined by the embodiments encompassed within the following claims and their equivalents.

What is claimed is:

1. A door stop for use on a door disposed above a floor surface and including an inner face and an outer face, the door stop comprising:

a base having an outer wall with a slotted opening therethrough between an inner and an outer surface of said outer wall, said inner surface including a plurality of projections extending outwardly relative thereto, mounting means adapted to mount said base relative to the inner face of the door;

a leg including a wall having an opening, an upper portion and a lower end, said upper portion being pivotally connected to said base about a pivot axis such that said leg is pivotable to an operative position in which said lower end extends outwardly relative to said base so as to be engageable with the floor surface; means for resiliently biasing said leg outwardly away from said base; and a locking member including a front portion and a rear portion extending rearwardly through said opening in said leg and said slotted opening in said outer wall of said base, said rear portion including a locking portion extending laterally beyond said slotted opening in said outer wall of said base and adapted to engage said plurality of projections of said inner surface of said outer wall of said base to retain said leg in the operative position, and said front portion extending outwardly relative to said opening in said wall of said leg and being in generally abutting relationship with said wall of said leg in the operative position.

2. The door stop of claim 1, wherein said plurality of projections on said inner surface of said outer wall of said base includes vertically spaced protuberances which extend outwardly from said rear surfaces between which said locking portion of said locking member is selectively seated when in said operative position to thereby prevent vertical shifting of said locking member relative to said base.

3. The door stop of claim 1, in which said mounting means includes a mounting bracket having clamping means for detachably clamping to the door.

4. The door stop of claim 3 in which said clamping means of said mounting bracket has a first wall, a second wall and a resilient element secured to said second wall, said first wall being adapted to abut the inner face of the door with said resilient element asserting a clamping force on the outer face of the door when said mounting bracket is mounted on the door.

5. The door stop of claim 3 in which said clamping element of said mounting bracket has a stationary wall, a movable wall, and a resilient element secured to said movable wall to resiliently urge said movable wall toward said stationary wall, said stationary wall being adapted to contact the inner face of the door with said movable wall asserting a clamping force on the outer face of the door when said mounting bracket is mounted on the door.

6. The door stop of claim 5, wherein said movable wall comprises at least one pair of horizontally spaced mounting elements, said base having at least one pair of horizontally spaced mounting holes, said mounting elements being insertable in said mounting holes to connect said base to said mounting bracket.

7. The door stop of claim 6, wherein said base includes a plurality of pairs of horizontally spaced mounting holes being respectively positioned in a vertically spaced relationship, said mounting elements being insertable in a selected pair of mounting holes to connect said base to said mounting bracket.

8. The door stop of claim 3 in which said clamping element of said mounting bracket has a stationary wall, a movable wall and cam means for moving said movable wall toward said stationary wall, said movable wall being adapted to assert a clamping force on the outer face of the door with said stationary wall contacting the inner face of the door when said mounting bracket is mounted on the door.

9. The door stop of claim 8, wherein said movable wall comprises at least one pair of horizontally spaced mounting elements, said base having at least one pair of horizontally spaced mounting holes, said mounting elements being insertable in said mounting holes to detachably connect said base to said mounting bracket.

10. The door stop of claim 9, wherein said base includes a plurality of pairs of horizontally spaced mounting holes respectively positioned in a vertically spaced relationship, said mounting elements being insertable in a selected pair of mounting holes to detachably connect said base to said mounting bracket.

11. The door stop of claim 3, wherein said mounting bracket comprises at least one pair of horizontally spaced mounting elements disposed on said first wall, said base having at least one pair of horizontally spaced mounting holes, said mounting elements being insertable in said mounting holes to connect said base to said mounting bracket.

12. The door stop of claim 11, wherein said base includes a plurality of pairs of horizontally spaced mounting holes being respectively positioned in a vertically spaced relationship, said mounting elements being insertable in a selected pair of mounting holes to connect said base to said mounting bracket.

13. The door stop of claim 1, wherein said plurality of projections are vertically spaced and extend outwardly from said inner surface of said outer wall of said base on opposite sides of said slotted opening, said front portion of said locking member includes a locking release portion, said locking portion of said locking member being engageable between said vertically spaced projections in an approximately perpendicular relationship to said inner surface of said base to thereby retain said leg in an inclined position relative to said base, and said locking portion being disengageable from between said vertically spaced projections by applying force to said locking release portion to enable said leg to be pivoted relative to said base.

14. The door stop of claim 13, wherein said locking member includes an intermediate portion which is curved upwardly and outwardly from said locking portion to said front portion, and said front portion of said locking member includes side portions engageable with opposite side walls of said leg in said operative position.

15. The door stop of claim 14, wherein said projections extend generally horizontally along substantially the width of said inner surface of said outer wall of said base, and said locking portion of said locking member is of a width substantially equal to the width of said inner surface of said outer wall of said base.

16. The door stop of claim 13, wherein said front portion of said locking member includes a flat portion and said rear portion is shaped such that in the operative position, said flat portion is retained in a generally parallel abutting relationship with said wall of said leg when said leg is in the operative position.

17. A door stop for use on a door disposed above a floor surface and including an inner face and an outer face, the door stop comprising:

a mounting bracket adapted to be mounted to the door including a front wall, and mounting elements disposed on said front wall;

a base including a wall having inner and outer surfaces and having an opening therethrough, said inner surface including a plurality of areas which are recessed with respect to adjacent areas;

a leg including a wall having an opening, an upper portion and a lower end, said upper portion being pivotally connected to said base about a pivot axis such that said leg is pivotable to an operative position in which said lower end engages the floor surface;

means for resiliently biasing said leg outwardly away from said base; and a locking member including a generally flat front portion and a rear portion extending rearwardly through said opening in said wall of said leg and said opening in said wall of said base, said rear portion including a locking portion adapted to engage within at least one of said areas which are recessed with respect to adjacent areas along said inner surfaces of said wall of said base in an approximately perpendicular relationship to retain said leg in the operative position, and said generally flat front portion being in generally abutting relationship with said wall of said leg in the operative position.

18. The door stop of claim 17, wherein said inner surfaces of said wall of said base has a plurality of vertically spaced areas which are recessed relative to adjacent vertically spaced areas located on opposite sides of said opening in said wall of said base and, said locking member including a locking release portion extending outwardly from said wall of said leg, said locking portion of said locking member being engageable within said areas which are recessed on opposite sides of said opening in said base to retain said leg in an inclined position relative to said base, and said locking portion being disengageable from said said areas which are recessed by applying force to said locking release portion to enable said leg to be pivoted about said base.

19. The door stop of claim 18, wherein said areas which are recessed are formed by a plurality of vertically spaced protuberances extending from said inner surface of said wall of said base, said locking portion of said locking member being engageable between said protuberances.

20. The door stop of claim 19, wherein said front portion of said locking member includes a generally flat portion and said rear portion is shaped such that said generally flat portion is maintained in a generally parallel abutting relationship with said wall of said leg in the operative position when a force is applied to the outer face of the door.

21. The door stop of claim 17, wherein said front portion of said locking member includes a generally flat portion and said rear portion is shaped such that in the operative position, said flat portion is retained in a generally parallel abutting relationship with said wall of said leg when said leg of the door stop is in said operative position and an inward directed force is applied to the outer face of the door.

* * * * *